US008754771B2

(12) United States Patent
Falkenberg et al.

(10) Patent No.: US 8,754,771 B2
(45) Date of Patent: Jun. 17, 2014

(54) METHOD, A DEVICE AND A SYSTEM FOR PREVENTING FALSE ALARMS IN A THEFT-PREVENTING SYSTEM

(75) Inventors: Verner Falkenberg, Copenhagen (DK); Soren Sorensen, Fagetto Lario (IT)

(73) Assignee: Alert Metalguard APS, Copenhagen V. (DK)

( * ) Notice: Subject to any disclaimer, the term of this patent is extended or adjusted under 35 U.S.C. 154(b) by 1137 days.

(21) Appl. No.: 12/450,788

(22) PCT Filed: Apr. 11, 2008

(86) PCT No.: PCT/EP2008/054414

§ 371 (c)(1), (2), (4) Date: Dec. 7, 2010

(87) PCT Pub. No.: WO2008/125621

PCT Pub. Date: Oct. 23, 2008

(65) Prior Publication Data

US 2011/0074581 A1 Mar. 31, 2011

(30) Foreign Application Priority Data

Apr. 13, 2007 (DK) ..... 200700543

(51) Int. Cl.
*G08B 13/14* (2006.01)

(52) U.S. Cl.
USPC ..... 340/568.1; 340/551; 340/552; 340/561; 340/521; 324/227; 324/239; 324/326; 324/244

(58) Field of Classification Search
USPC ..... 340/568.1, 551, 552, 540, 561, 521; 324/227, 224, 226, 243, 244, 329, 239, 324/326
See application file for complete search history.

(56) References Cited

U.S. PATENT DOCUMENTS

| | | | | |
|---|---|---|---|---|
| 4,697,170 | A | 9/1987 | Hoekman | |
| 4,791,412 | A | 12/1988 | Brooks | |
| 5,276,430 | A * | 1/1994 | Granovsky | 340/572.4 |
| 5,506,506 | A * | 4/1996 | Candy | 324/329 |
| 6,133,829 | A | 10/2000 | Johnstone et al. | |
| 6,150,810 | A | 11/2000 | Roybal | |

(Continued)

FOREIGN PATENT DOCUMENTS

| | | |
|---|---|---|
| EP | 0 435 198 B1 | 7/1991 |
| EP | 0 736 850 B2 | 10/1996 |

(Continued)

*Primary Examiner* — Hoi Lau
(74) *Attorney, Agent, or Firm* — Jacobson Holman, PLLC

(57) ABSTRACT

The invention relates to a method, a device and a system for preventing false alarms in a theft-preventing system comprising a magnetic field for detecting at least one metal object in a first detection zone and means for determining a time-difference; said method comprising the steps of detecting a first change in a parameter indicative of the magnetic field in said first detection zone; detecting a second change in the parameter indicative of the magnetic field in said first detection zone; determining a time-difference between the detection of said first change in said parameter and the detection of said second change in said parameter; and performing an action based on said time-difference. In this way, false alarms due to a metal detector falsely detecting for example movement of metal-doors in a first detection zone may be reduced/eliminated. Additionally, the false alarms due to an opening and/or closing of a door with metal parts acting as an active tag may be reduced/eliminated.

23 Claims, 5 Drawing Sheets

(56) References Cited

U.S. PATENT DOCUMENTS

| | | | | |
|---|---|---|---|---|
| 6,504,364 | B1 * | 1/2003 | Eidenvall et al. | 324/239 |
| 6,528,989 | B1 * | 3/2003 | Hansen | 324/207.12 |
| 6,541,966 | B1 * | 4/2003 | Keene | 324/243 |
| 6,583,625 | B1 * | 6/2003 | Castle | 324/329 |
| 7,123,016 | B2 * | 10/2006 | Larsen | 324/326 |
| 7,154,266 | B2 | 12/2006 | Czipott et al. | |
| 7,295,107 | B2 | 11/2007 | Massengill et al. | |
| 7,319,321 | B2 * | 1/2008 | Murray et al. | 324/244 |
| 7,355,409 | B2 * | 4/2008 | Larsen | 324/326 |
| 7,592,907 | B2 * | 9/2009 | Manneschi et al. | 340/521 |
| 7,701,204 | B2 * | 4/2010 | Westersten | 324/228 |
| 7,889,076 | B2 * | 2/2011 | Manneschi et al. | 340/561 |
| 7,948,428 | B2 * | 5/2011 | Lovberg et al. | 342/22 |
| 8,063,777 | B2 * | 11/2011 | Candy | 340/540 |
| 2002/0005783 | A1 * | 1/2002 | Irizarry et al. | 340/572.1 |
| 2002/0093338 | A1 * | 7/2002 | Rowan | 324/329 |
| 2003/0137420 | A1 * | 7/2003 | Turner et al. | 340/572.1 |
| 2005/0242817 | A1 * | 11/2005 | Hoult | 324/326 |
| 2006/0092014 | A1 * | 5/2006 | Onderko et al. | 340/539.13 |
| 2006/0197523 | A1 * | 9/2006 | Palecki et al. | 324/244 |
| 2007/0013372 | A1 * | 1/2007 | Murray et al. | 324/244 |
| 2007/0030105 | A1 * | 2/2007 | Manneschi et al. | 335/299 |
| 2007/0030141 | A1 * | 2/2007 | Manneschi et al. | 340/500 |
| 2007/0126576 | A1 * | 6/2007 | Script et al. | 340/545.5 |
| 2007/0182818 | A1 * | 8/2007 | Buehler | 348/143 |
| 2008/0074114 | A1 * | 3/2008 | Candy | 324/326 |
| 2008/0084301 | A1 * | 4/2008 | Roybal et al. | 340/551 |
| 2008/0191925 | A1 * | 8/2008 | Martin et al. | 342/22 |
| 2008/0231443 | A1 * | 9/2008 | Kotter et al. | 340/551 |
| 2009/0167299 | A1 * | 7/2009 | Nishio et al. | 324/239 |
| 2009/0315707 | A1 * | 12/2009 | Candy | 340/540 |
| 2011/0001812 | A1 * | 1/2011 | Kang et al. | 348/77 |

FOREIGN PATENT DOCUMENTS

| | | | |
|---|---|---|---|
| EP | 0 880 763 | B1 | 12/1998 |
| GB | 2 228 332 | A | 8/1990 |
| GB | 2 247 382 | | 2/1992 |
| GB | 2 247 383 | A | 2/1992 |
| JP | 8 050 690 | A | 2/1996 |
| JP | 2000 067332 | A | 3/2000 |

* cited by examiner

METHOD, A DEVICE AND A SYSTEM FOR PREVENTING FALSE ALARMS IN A THEFT-PREVENTING SYSTEM

This is a national stage of PCT/EP08/054,414 filed Apr. 11, 2008 and published in English, which has a priority of Denmark no. PA200700543 filed Apr. 13, 2007, hereby incorporated by reference.

FIELD OF THE INVENTION

The invention relates to a method of preventing false alarms in a theft-preventing system. Further, the invention relates to a method of preventing false alarms in a theft-preventing system comprising a magnetic field in a first detection zone. Additionally, the invention relates to a device and a system for preventing false alarms in a theft-preventing system.

BACKGROUND OF THE INVENTION

One group of theft-preventing systems uses antitheft tags attached to articles. Before leaving the shop the antitheft tags must be removed or deactivated by the staff in the shop. At the exit doorway a detector is arranged for detecting the presence of antitheft tags in a detection zone near the doorway. If an article is brought out of the shop with an antitheft tag still attached, the detector will detect the antitheft tag and give an alarm or other indication, and appropriate action can be taken.

Several theft-preventing systems exist. In one system the antitheft tags have an electrical resonance circuit with an inductor coil and a capacitor tuned to a predetermined resonance frequency, typically in the MHz range. At the exit doorway a transmitter antenna emits an electromagnetic signal comprising the resonance frequency of the antitheft tags into the detection zone. The signal from the transmitter antenna will excite possible antitheft tags in the detection zone to "ring" at their resonance frequencies. A receiver antenna will detect such ringing. Antitheft tags of this system can have wide tolerances to the accuracy of the resonance frequency, and the electromagnetic transmitter antenna can emit a broadband signal covering the interval of tolerance on the resonance frequency of the tags.

Another known system uses antitheft tags with an RFID chip containing data that can be detected by the system that emits an interrogation signal. RFID tags in the detection zone respond to the interrogation signal by emitting a signal with some or all data, and possibly revealing their identity.

A further known system uses a diode or other electrically non-linear element in the tags. Such tags respond to the electromagnetic signal from the transmitter antenna by emitting harmonic frequencies that are detected and taken as an indication of an antitheft tag being in the detection zone.

A known way of circumventing these tag-based antitheft systems is to coat a bag or other type of container with aluminium foil or another metal such as for example tin-foil and put the tagged item into the bag. Thereby the tagged item will be in a Faraday cage and as the detection zone is passed the signal from the tagged item will not reach the detection system and thus the tagged item will be removed from the shop without any alarm being given off. The abovementioned metal-coated bag is known as a booster bag. Alternatively or additionally, a shoplifter may coat for example a piece of clothing such as for example an overcoat and use the piece of clothing to shield the signal from the tagged item from reaching the detection system. Such a metal coated piece of clothing may be comprised by the term booster bag in this application.

A solution to this problem is to have a metal detector system in the detection zone or in proximity to the detection zone, either as a stand alone system or integrated into the tag-based detection system. The metal detector is sensitive to movements of metal objects in the detection zone of the metal detector. Thereby, metal objects passing the detection zone can be detected. The metal detection systems will typically be based on a magnetic field transmitter and a magnetic field detector/receiver.

The abovementioned magnetic field based metal detector systems can present problems when used near a door with two or more metal parts that are joined, such as a door with a frame of aluminium profiles mechanically joined at the corners. The magnetic field from the transmitter will couple through the metal frame of the door and yield a contribution to the magnetic field detected at the receiver. As the door opens to a customer entering or leaving the store, the coupling of the magnetic field though the doorframe will be broken and the signal supplied by the doorframe at the receiver will disappear. The metal detection system will detect this, due to a decrease in the detected magnetic field strength at the receiver, as a moving metal object entering the detection zone and may thus cause a false alarm. As the door closes after a customer entering or leaving the store, the magnetic field may again couple through the door and the signal supplied by the doorframe at the receiver will reappear. The metal detection system may also detect this, due to an increase in the detected magnetic field strength at the receiver, as a moving metal object out of the detection zone and thus cause a false alarm.

Further, the door comprising one or more metal parts opening and closing to customers may—also—present a problem to the tag-based antitheft system. Such a door may act as an active tag and therefore an opening and/or closing door comprising one or more metal parts can also influence the tag-based detector system.

Thus, in an antitheft detection system comprising a tag-based antitheft system and a metal detector, the problem of a door with metal parts is twofold: Firstly, the metal detector may falsely detect the movement of the door as a metal object in the detection zone of the metal detector yielding a false alarm. Secondly, the opening and/or closing door with metal parts may act as an active tag influencing the tag-based detection system.

SUMMARY OF THE INVENTION

It is an object of the present invention to, among other things, solve the abovementioned problems. The abovementioned problems are solved by a method of preventing false alarms in a theft-preventing system comprising a magnetic field for detecting at least one metal object in a first detection zone and means for determining a time-difference; said method comprising the steps of detecting a first change in a parameter indicative of the magnetic field in said first detection zone; detecting a second change in the parameter indicative of the magnetic field in said first detection zone; determining a time-difference between the detection of said first change in said parameter and the detection of said second change in said parameter; and performing an action based on said time-difference.

In this way, the method is able to determine, whether a metal object in the first detection zone providing a change in the parameter indicative of the magnetic field, is of a size that requires an alarm to be activated (and/or otherwise provide an indication of the metal object in the first detection zone) based on the time-difference between the metal object entering the first detection zone (providing a first change in the parameter) and exiting the first detection zone (providing a second change in the parameter). E.g. a metal door may provide a time-difference of a magnitude and may thus be prevented from causing alarms in the theft-preventing system. E.g. a booster bag may provide another time-difference of another magnitude and may thus cause alarms in the theft-preventing system.

Additionally, the method is able to prevent a metal-door from acting as an active tag in a tag-based theft-preventing system. If, for example, the action performed is to provide a signal indicative of the time-difference to a tag-based theft-preventing system, the method may refrain the tag-based system from acting on a metal door acting as an active tag.

In an embodiment, the step of detecting a first change in a parameter indicative of the magnetic field in said first detection zone comprises detecting a decrease in the parameter.

In this way, the method is able to detect, for example, a metal object entering into the first detection zone, said entering providing a decrease in the parameter indicative of the magnetic field due to a shielding effect of the metal object entering the first detection zone.

In an embodiment, the step of detecting a second change in the parameter indicative of the magnetic field in said first detection zone comprises detecting an increase in the parameter.

In this way, the method is able to detect, for example, a metal object exiting the first detection zone, said exiting providing an increase in the parameter indicative of the magnetic field due to the removal of the shielding effect of the metal object leaving the first detection zone.

In an embodiment, the parameter indicative of the magnetic field is chosen from the group consisting of amplitude of the magnetic field; and/or phase of the magnetic field.

The amplitude and/or the phase of the magnetic field may change when a metal object enters and/or leaves the first detection zone and thus may be used as parameters to determine the time-difference.

In an embodiment, the step of performing an action based on said time-difference comprises performing a first action if said time-difference is above a first value; and performing a second action if said time-difference is below or equal to said first value.

Thus, the method may perform one action when a metal object has a size (time-difference) above certain limit and another action when the metal object size (and thus associated time-difference) is below or equal to said limit.

In an embodiment, the second action is chosen from the group consisting of sounding an alarm; transmitting a silent alarm to e.g. a pager; setting off a visual alarm; and transmitting a signal to a video-surveillance system indicating to the video-surveillance system to start monitoring.

In this way, the method may activate an alarm, if the time-difference of the metal object traversing the first detection zone is below or equal to a first value e.g. if the size of the metal object is of a certain size, for example, a small object such as a bag.

In an embodiment, the first action comprises refraining from sounding an alarm.

In this way, the method may ignore a metal object traversing the first detection zone, if the time-difference of the metal object traversing the first detection zone is above a first value e.g. if the size of the metal object is of a certain size, for example, a large object such as a trolley for shopping or the opening and closing of a door.

In an embodiment, the first value is chosen from the group consisting of substantially a second; and in the interval 0.5 seconds to 3 seconds.

Thereby, the method may determine that metal objects traversing the first detection zone in less than or equal to, for example, substantially one second are booster bags and thus to activate an alarm. Objects traversing the first detection zone in above, for example, substantially one second, may be determined not to be booster bags but for example trolley for shopping and/or the opening and/or closing of doors to customers and thus no alarm may be activated. The dimensions of the first detection zone may, for example, be, approximately in the order of 6, 10, 18, 30 cm in depth (the direction of passage of a metal object), distance between the transmitter 101 and the receiver 102 (width of the first detection zone) approximately in the order of 70-250 cm and the height of the first detection zone approximately in the order of 100-250 cm. Alternatively, the dimensions of the first detection zone may have any dimensions.

In an embodiment, the theft-preventing system further comprises a tag-based theft-preventing system for detecting a tagged object in a second detection zone.

The action performed may, for example, comprise providing a signal to the tag-based system from the metal detector if the metal detector has detected the opening and/or closing of a door comprising one or more metal parts in the first detection zone such that if the tag-based theft-preventing system substantially simultaneously detects a tagged object in the second detection zone, then the theft-preventing system may conclude that the tagged object detected was due to the opening and/or closing of the door and thus a false alarm. Thereby, the theft-preventing system according may prevent false alarms in the tag-based theft-preventing system due to the opening and/or closing of doors comprising metal parts.

In an embodiment, the tag-based system is chosen from the group consisting of resonance circuit system; RFID system; and Diode system.

In an embodiment, the overlap between said first detection zone and said second detection zone is chosen from the group of coinciding; disjoint; and partially overlapping.

Thereby, the metal detector may, for example, be placed such that the first detection zone (the magnetic field detection zone from e.g. metal detector) and the second detection zone (the tag-based detection zone) are substantially identical and thus the metal detector and the tag-based theft-preventing system may, for example, be grouped together e.g. integrated as a single device. Alternatively, the first and second detection zones may be disjoint and thus the metal detector may be placed apart from the tag-based theft-preventing system. Alternatively, the metal detector may be placed such that the first and second detection zones are partially overlapping.

The present invention relates to different aspects including the method described above and in the following, and also a corresponding device and/or system for preventing false alarms in a theft-preventing system, each aspect yielding one or more of the benefits and advantages described in connection with the first mentioned aspect, and each having one or more embodiments corresponding to the embodiments described in connection with the first mentioned aspect and/or disclosed in the appended claims and/or described in the detailed description of the drawings.

DETAILED DESCRIPTION OF THE DRAWINGS

Figure 1:
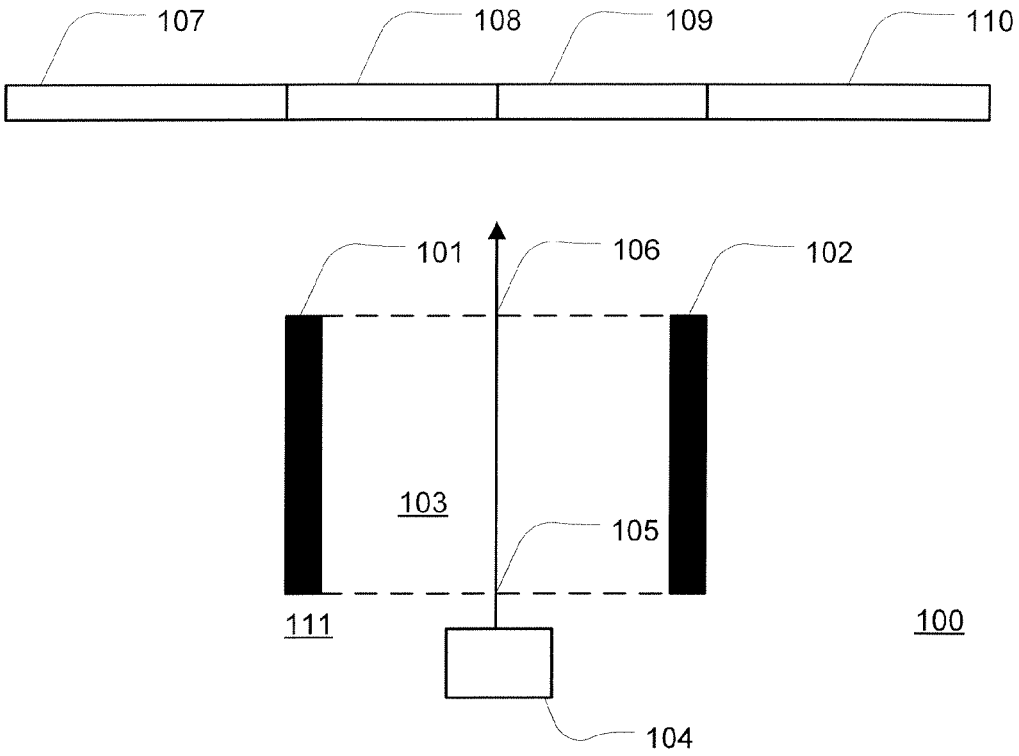
FIG. 1 shows a schematic illustration of the interior of a shop.

FIG. 1 shows, for example, a schematic illustration of the interior of a shop 100.

The shop 100 may comprise a metal detector 111; said metal detector 111 may comprise a magnetic field transmitter 101 and a magnetic field receiver 102. Between the magnetic field transmitter 101 and receiver 102, there may be a magnetic field provided by the magnetic field transmitter. The magnetic field may determine a first detection zone 103 in which one or more metal objects may be detected.

The shop may further comprise a wall 107 and 110 and in the wall, there may be a doorway for example comprising two sliding doors 108 and 109. The two sliding doors 108 and 109 may comprise a metal frame of e.g. extruded aluminium profiles being joined at the corners and a glass pane within the frame. The joining may be made by mechanical means such as for example screws.

Alternatively, the doors 108 and 109 may be hinged doors. Alternatively, the doors may be any type of doors suitable for opening and closing in a doorway. The doors 108 and 109 may open such that a person and/or object may traverse the doorway comprising the doors 108 and 109. Alternatively, the doorway may comprise a single door.

In the shop 100, there may further be a metal object 104. The metal object may, for example, be a booster bag. Alternatively, the metal object may be any other type of metal object such as for example a trolley of shopping made of metal and/or comprising a metal part.

Figure 2:
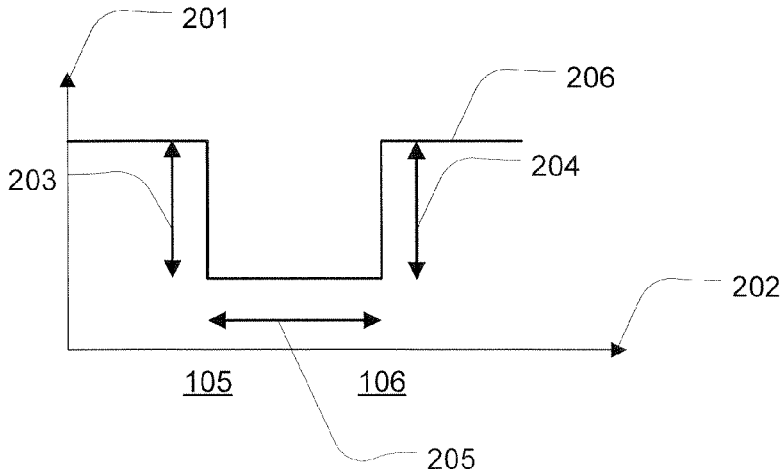
FIG. 2 schematically illustrates a received magnetic field strength received at a magnetic field receiver of a metal detector versus time when a metal object traverses a first detection zone of the metal detector.

FIG. 2 schematically illustrates a received magnetic field signal 201 received at the magnetic field receiver 102 of the metal detector 111 versus time 202 when a metal object 104 traverses the first detection zone 103.

When the metal object 104 enters the first detection zone 103 at e.g. 105, the magnetic field receiver 102 may detect a decrease 203 in the magnetic field signal 201 received from the magnetic field transmitter 101 due to the presence of the metal object in the first detection zone 103. When the metal object leaves the first detection zone 103 at e.g. 106, the magnetic field receiver 102 may detect an increase in the magnetic field signal 204 received from the magnetic field transmitter 101 due to the leaving of the metal object 104 from the first detection zone 103.

The metal detector 111 may assign a time value to the metal object 104 passing the first detection zone 103, the time value may for example be defined as the time difference 205 between the time when the metal object 104 enters the first detection zone 103 at 105 and the time when the metal object 104 leaves the first detection zone 103 at 106.

Figure 10:
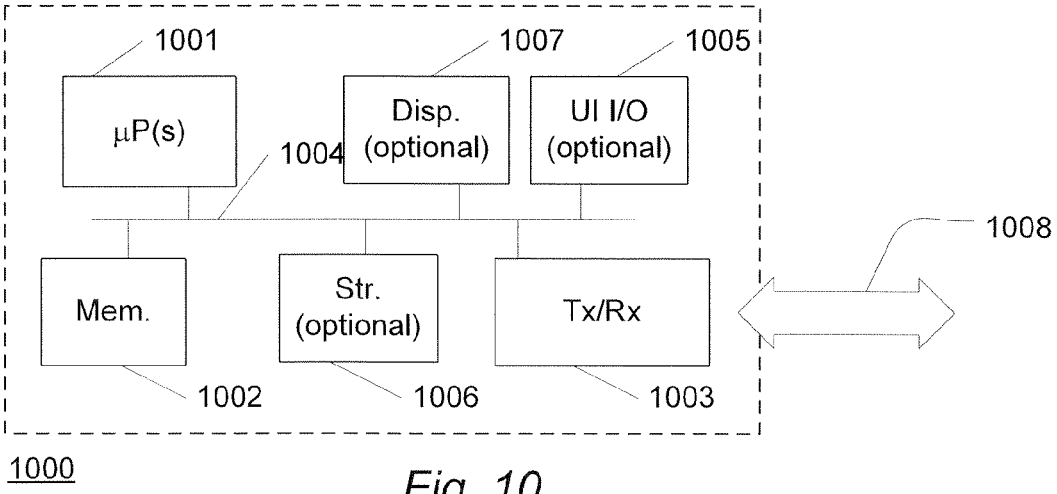
FIG. 10 shows a data processing device.

In an embodiment, the metal detector 111 may comprise or be communicatively coupled to a data processing device 1000 according to FIG. 10.

In general, the time-difference may, for example, be determined by having a digital clock, e.g. part of the data processing device 1000, communicatively coupled to the metal detector. The metal detector 111 may transmit a start signal via a wireless and/or wired communication link 1008 to the data processing device 1000 when the decrease 203 in the magnetic field is detected. Upon receipt of the start signal, the data processing device may start the digital clock at a first time instance.

The metal detector 111 may transmit a stop signal via a wireless and/or wired communication link 1008 to the data processing device 1000 when the increase 204 in the magnetic field is detected. Upon receipt of the stop signal, the data processing device may stop the digital clock at a second time instance.

The data processing device 1000 may determine the time difference between as the difference between the first and the second time instances. In an embodiment, the time difference may be transmitted from the data processing device 1000 to the metal detector 111 via the wireless and/or wired communication link 1008.

The metal detector 111 and/or the data processing device may determine an action based on the value of the time-difference 205. If the time-difference is less than a value, for example 1.5 seconds, the metal detector 111 and/or data processing device 1000 may determine that the metal object 104 passing the first detection zone 103 was/is a booster bag and thus the metal detector 111 may sound an alarm and/or otherwise provide an indication of the nature of the object traversing the first detection zone to for example security personnel of the shop 100.

If the time-difference 205 is above the abovementioned value, for example if the time-difference 205 is approximately 4 seconds, the metal detector 111 and/or data processing device 1000 may determine that the metal object 104 passing the first detection zone 103 was a trolley of shopping and thus the metal detector 111 and/or data processing device 1000 may refrain from sounding an alarm and thereby the metal detector 111 and/or data processing device 1000 may prevent a false alarm due to the entering and leaving of a trolley of shopping in the first detection zone 103.

The abovementioned assigned time-differences are examples and any value may be used to, for example, discriminate between metal objects 104 of different types.

Additionally, there may, for example, be a first plurality of time-difference values assigned to different metal objects. For example, metal objects having assigned a time-difference below or equal to a first value are determined to be, for example, booster bags in which case an alarm may be activated.

Additionally, a second plurality of time-differences may be assigned to the metal detection system 111 based on the environment of the metal detector 111.

For example, a metal detector 111 placed in proximity, e.g. within 1 meter, to a swinging metal door may be assigned a first time-difference in order to be able to discriminate the movement of the swinging metal door. A metal detector 111 placed in proximity, e.g. within 1 meter, to a revolving metal door may be assigned a second time-difference in order to be able to discriminate the movement of the revolving metal door.

In an embodiment, the time-difference may be chosen from the interval 0.5 seconds to 4 second. Alternatively, the time-difference may be chosen from the interval 0.5 second to 3 seconds.

In general, the time-difference may be set to a value depending on the environment and/or the objects to be detected in the metal detector 111.

Metal objects having assigned a time-difference above said first time value and below or equal to a second time value may, for example, be determined to be trolleys for shopping and thus a silent alarm may be activated at a shop detective and/or cashier, such that the shop detective and/or cashier may observe the trolley for shopping in order to visually determine whether the trolley is empty. Alternatively, the silent alarm may activate a video surveillance system enabling an operator to identify and monitor the trolley.

Metal objects having assigned a time-difference above said second time value may, for example, be determined to be metal door opening and/or closing to customers and thus the metal detection system may refrain from activating an alarm.

In the above and in the below, the magnetic field signal 201 may, for example, be a magnetic field strength. Alternatively of additionally, the magnetic field signal 201 may, for example, be a magnetic field phase. Alternatively, the magnetic field signal 201 may be any type of signal indicative of a metal object 104 traversing the first detection zone 103.

Figure 3:
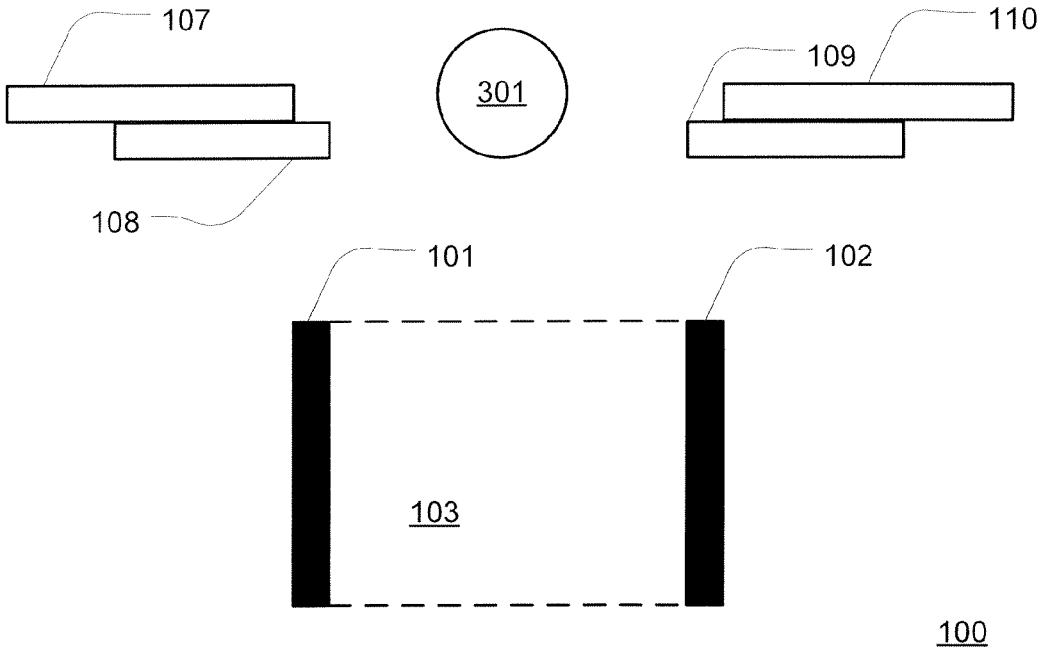
FIG. 3 schematically illustrates a person entering or leaving a store comprising a metal detector.

FIG. 3 schematically illustrates a person 301 entering or leaving the store 100 comprising a metal detector 111.

If the doors 108 and 109 of the doorway open to a person, 301, entering or leaving the shop 100, the metal detector 111 may detect a decrease 203 in the magnetic field signal 201 received from the magnetic field transmitter 101 due to the breaking of the coupling of the magnetic field though the frame of the doors 108 and 109.

The breaking of the coupling of the magnetic field through the frame of the doors 108 and 109 may thus provide a decrease in the detected magnetic field received by the magnetic field receiver 102 in the same way as a metal object 104 entering the first detection zone 103.

When the doors 108 and 109 of the doorway close after having been opened to a person, 301, entering or leaving the shop 100, the metal detector 111 may detect an increase 204 in the magnetic field signal 201 received from the magnetic field transmitter 101 due to the re-coupling of the magnetic field though the frame of the closed doors 108 and 109.

The re-coupling of the magnetic field through the frame of the doors 108 and 109 may thus provide an increase in the detected magnetic field received by the magnetic field receiver 102 in the same way as a metal object 104 leaving the first detection zone 103.

The metal detector 111 may determine a time-difference 205 representing the doors 108 and 109 opening and closing to a person 301 entering or leaving the store 100. Based on the value of the time-difference 205 which may in this case for example be 10 seconds, the metal detector 111 may determine that detected decrease 203 and increase 204 in the magnetic field signal 201 was due to the opening and closing of the doors 108 and 109 to a person entering or leaving the store 100 and thus the metal detector 111 may refrain from sounding an alarm and thereby the metal detector 111 may prevent a false alarm from occurring due to the opening and closing of the doors 108 and 109.

Figure 4:
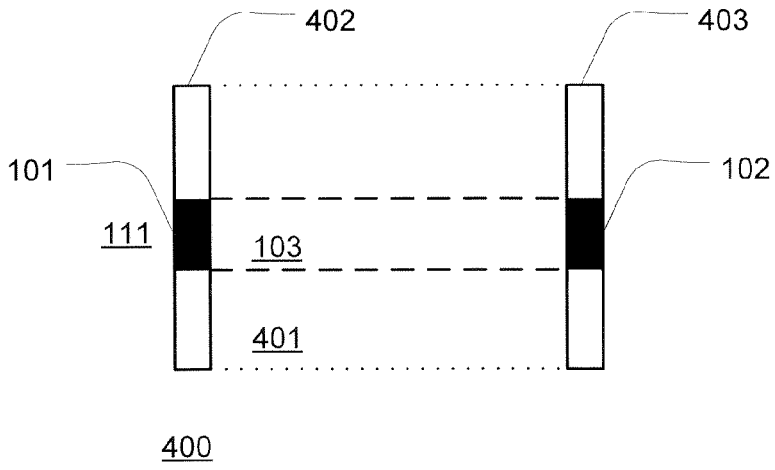
FIG. 4 schematically illustrates a tag-based antitheft system comprising a metal detector.

FIG. 4 schematically illustrates an additional embodiment comprising a tag-based antitheft system 400. The system 400 may, for example, comprise a transmitter antenna 402 emitting an electromagnetic signal comprising a resonance frequency of an antitheft tag. The signal from the transmitter antenna 402 may excite possible antitheft tags in a second detection zone to "ring" at their resonance frequencies. A receiver antenna 403 may detect such ringing. The transmitter antenna 402 and the receiver antenna 403 may determine a second detection zone 401 in which tags may be detected.

The system 400 may further comprise a metal detector 111. The metal detector 111 may comprise a magnetic field transmitter 101 and a magnetic field receiver 102. Between the magnetic field transmitter 101 and receiver 102, there may be a magnetic field provided by the magnetic field transmitter. The magnetic field may determine a first detection zone 103 in which one or more metal objects may be detected.

The second detection zone 401 and the first detection zone 103 may be substantially identical such that the second detection zone 401 is substantially as large as, and overlapping, the first detection zone 103.

Alternatively, the second detection zone 401 may comprise the first detection zone 103 such that the second detection zone 401 is larger than the first detection zone 103 and the second detection zone 401 comprises the first detection zone 103.

Alternatively, the first detection zone 103 may comprise the second detection zone 401 such that the first detection zone 103 is larger than the second detection zone 401 and the first detection zone 103 comprises the second detection zone 401.

A problem of the tag-based antitheft system 400 is that the opening and/or closing of one or more doors comprising metal, e.g. comprising a metal frame, may generate a false alarm in the tag-based antitheft system 400.

However, by enabling a metal detector 111 to be grouped together with the tag-based antitheft system may prevent false alarms in the tag-based system 400 due to the opening and/or closing of one or more doors comprising metal.

The metal detector 111 may, for example, provide a signal to the tag-based antitheft system 400, and the signal may indicate whether the metal detector 111 has detected the opening and/or closing of the one or more doors as disclosed above under FIG. 3.

If the metal detector 111 has detected an opening and/or closing of the one or more doors, and if the tag-based antitheft system experiences an alarm state substantially at the same time, e.g. a false alarm due to the opening and/or closing of the one or more doors, then the signal provided by the metal detector 111 to the tag-based antitheft system 400 may be of such a value, e.g. a high bit/value, that the false alarm induced in the tag-based anti-theft system due to the opening and/or closing of the one or more doors may be aborted.

If the metal detector did has not detect an opening and/or closing of the one or more doors, and if the tag-based antitheft system experiences an alarm state, e.g. a tag being moved through the second detection zone 401, then the signal provided by the metal detector 111 to the tag-based antitheft system 400 may be of such a value, e.g. a low bit/value, that the alarm induced in the tag-based antitheft system due to the moving of a tag through the second detection zone 401 may not be aborted.

Alternatively or additionally, the metal detector 111 may detect metal objects 104 traversing the first detection zone 103 as disclosed above and thereby the metal detector 111 may prevent e.g. booster bags from being transported through the system 400. Additionally, the metal detector may provide a signal to the tag-based antitheft system 400, if the metal detector 111 detects e.g. a booster bag.

Alternatively or additionally, the metal detector 111 may, for example, provide a signal to the tag-based antitheft system 400, if the metal detector 111 has detected the metal object 104 such as a trolley of shopping in the first detection zone 103.

In an additional embodiment, the metal detector 111 may, for example, provide a signal to the tag-based antitheft system 400, if the metal detector 111 detects a door opening. A door opening may, for example, be detected by a decrease in the magnetic field signal of a certain size and/or of a certain time-width.

Additionally or alternatively, the metal detector 111 may provide a signal to the tag-based antitheft system 400, if the metal detector 111 detects a door closing. A door closing may, for example, be detected by a certain increase in the magnetic field signal.

Figure 5:
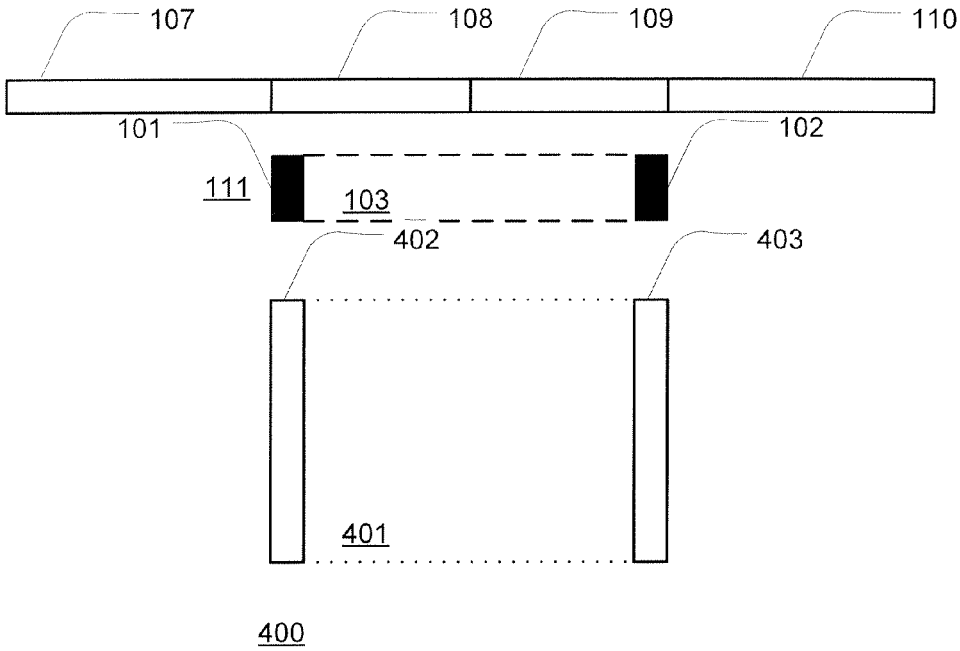
FIG. 5 schematically illustrates a tag-based antitheft system comprising a metal detector, said metal detector being placed outside the second detection zone of the tag-based antitheft system.

FIG. 5 schematically illustrates an additional embodiment comprising a tag-based antitheft system 400 comprising a metal detector 111. In this embodiment, the magnetic field transmitter 101 and magnetic field receiver 102 of the metal detector 111 are placed outside the second detection zone 401 of the tag-based antitheft system 400. The metal detector may, for example, be placed between the doors 108 and 109 and the tag-based antitheft system 400 as illustrated in FIG. 5 and thus the first detection zone 103 of the metal detector 111 is outside the second detection zone 401 of the tag-based antitheft system 400.

By placing the metal detector 111 outside the tag-based antitheft system 400 detection zone 401 may reduce a field induced in the metal detector 111 by the tag-based antitheft system 400 and vice versa.

Figure 6:
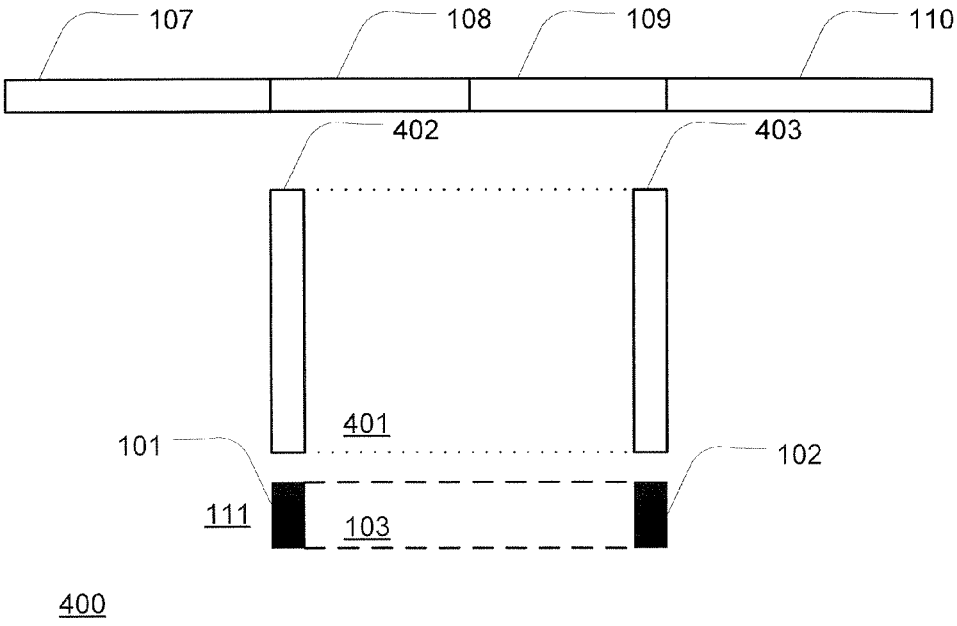
FIG. 6 schematically illustrates a tag-based antitheft system comprising a metal detector, said metal detector being placed outside the second detection zone of the tag-based antitheft system.

FIG. 6 schematically illustrates an additional embodiment comprising a tag-based antitheft system 400 comprising a metal detector 111. In this embodiment, the magnetic field transmitter 101 and magnetic field receiver 102 of the metal detector 111 are placed outside the second detection zone 401 of the tag-based antitheft system 400. The metal detector may, for example, be placed after the doors 108 and 109 and after the tag-based antitheft system 400 as illustrated in FIG. 6. Thereby, the first detection zone 103 of the metal detector 111 is outside the second detection zone 401 of the tag-based antitheft system 400.

By placing the metal detector 111 outside the tag-based antitheft system 400 detection zone 401 may reduce the field induced in the metal detector 111 by the tag-based antitheft system 400 and vice versa.

Figure 7:
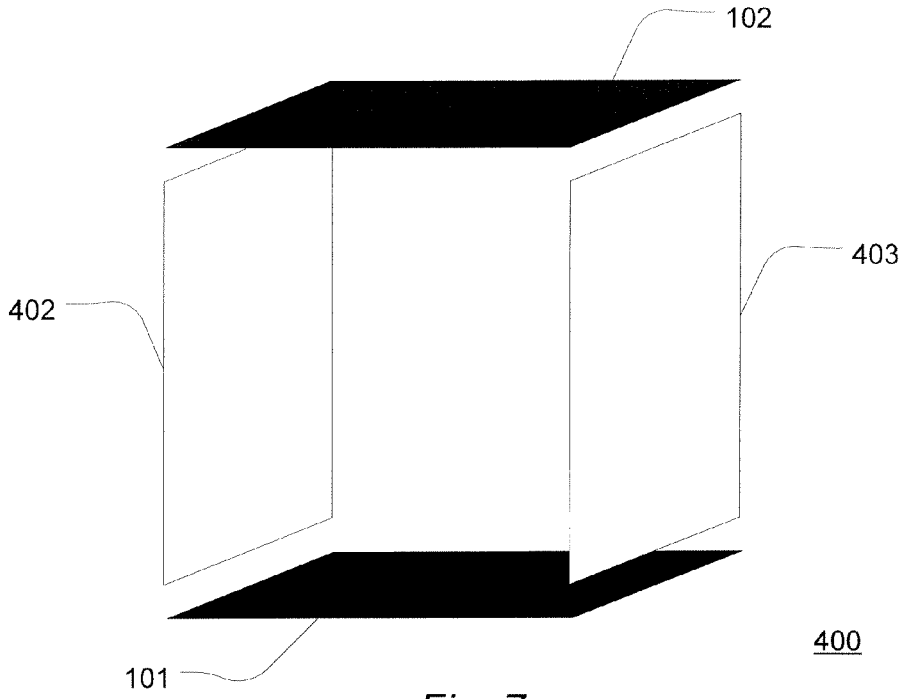
FIG. 7 schematically illustrates a tag-based antitheft system comprising a metal detector, said metal detector being placed in the floor and ceiling of a shop.

FIG. 7 schematically illustrates an additional embodiment comprising a tag-based antitheft system 400 comprising a metal detector 111. The tag-based antitheft system 400 may comprise a transmitter antenna 402 and a receiver antenna 403. The metal detector 111 may comprise a magnetic field transmitter 101 and a magnetic field receiver 102. The transmitter antenna 402 and the receiver antenna 403 may, for example be placed at the entrance of a shop e.g. next to a sliding door. The magnetic field transmitter 101 may, for example be placed in the floor of the shop e.g. at the entrance. The magnetic field receiver 102 may be placed in the ceiling of the shop e.g. at the entrance.

Placing the magnetic field transmitter 101 in the floor and the magnetic field receiver in the ceiling may further reduce the field induced in the metal detector 111 by the tag-based antitheft system 400 and vice versa.

Figure 8:
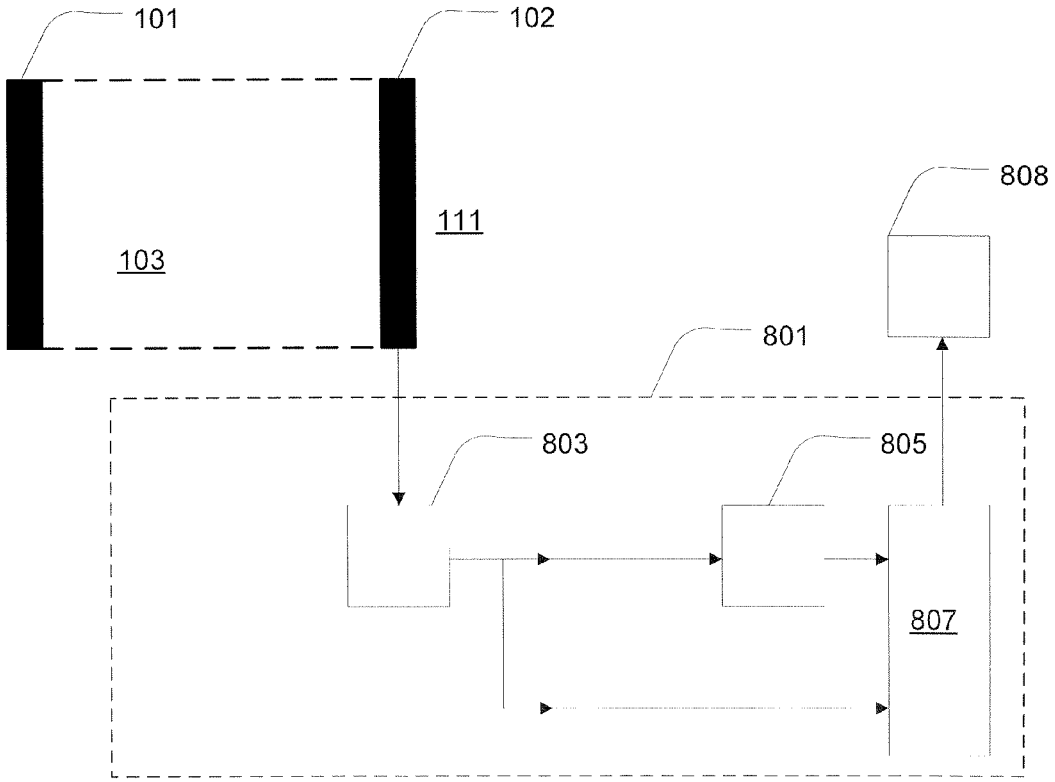
FIG. 8 schematically illustrates a metal detector comprising a detection circuit.

FIG. 8 schematically illustrates a metal detector 111 comprising a magnetic field transmitter 101 and a magnetic field receiver 102. The metal detector 111 may further comprise a detection circuit 801. The detection unit may, for example, be embodied as an integrated circuit. Alternatively or additionally, the detection unit may, for example, be embodied as a piece of software in a digital processing unit (such as for example a computer) executing the piece of software to achieve functionality substantially similar to the functionality of the integrated circuit.

The detection circuit 801 may comprise a receiver unit 803 for example connected to the magnetic field receiver 102 via an electrical cable. Alternatively, the receiver unit 803 may, for example, be connected to the magnetic field receiver 102 via an optical cable. Alternatively, the receiver unit 803 may, for example, be connected to the magnetic field receiver 102 via short range radio link such as for example Bluetooth.

The receiver unit 803 may determine if one or more metal objects 104 are present in the first detection zone 103, if one or more metal objects are entering the first detection zone 103, if one or more metal objects are leaving the first detection zone 103, and/or if no metal objects are present in the first detection zone 103, For example, the receiver unit 803 may determine that a metal object 104 is entering the first detection zone 103, e.g. by detecting a decrease 203 in the magnetic field signal of the signal received from the magnetic field receiver 102.

Further, the receiver unit 803 may, for example, determine that a metal object 104 is leaving the first detection zone 103, e.g. by detecting an increase 204 in the magnetic field signal of the signal received from the magnetic field receiver 102.

Further, the receiver unit 803 may, for example, determine that a metal object 104 is in the first detection zone 103, e.g. by detecting a plateau 205 in the magnetic field signal of the signal received from the magnetic field receiver 102.

Further, the receiver unit 803 may, for example, determine that no metal object 104 is in the first detection zone 103, e.g. by detecting a background magnetic field level 206 in the magnetic field signal of the signal received from the magnetic field receiver 102.

If, for example, the receiver unit 803 determines that a metal object 104 is entering the first detection zone 103, then the receiver unit 803 may send a start-signal to a timer 805, such that said timer 805 starts. The timer 805 may send the start-time to an alarm module 807. The alarm module 807 may, for example, comprise a digital signal processor.

If, for example, the receiver unit 803 determines that the metal object 104 is leaving the first detection zone 103, then the receiver unit 803 may send an end-signal to the alarm module 807. The alarm module 807 may determine a time-difference between the start-signal and the end-signal.

If the determined time-difference is above a value e.g. above 1.5 seconds, the alarm module may, for example, determine that the metal object 104 was not a booster bag and thus the alarm module may refrain from an action.

If the determined time-difference is below or equal to the value e.g. below or equal to 1.5 seconds, the alarm module may, for example, determine that the metal object 104 was a booster bag and thus the alarm module may send a signal to e.g. a device 808 such as for example a siren which may sound an alarm. Alternatively or additionally, the alarm module may send a signal to a device 808 such as a surveillance camera. Alternatively or additionally, the alarm module 807 may send a signal to a store detective. Alternatively or additionally, the alarm module 807 may send a signal to e.g. a tag-based theft-preventing system.

Figure 9:
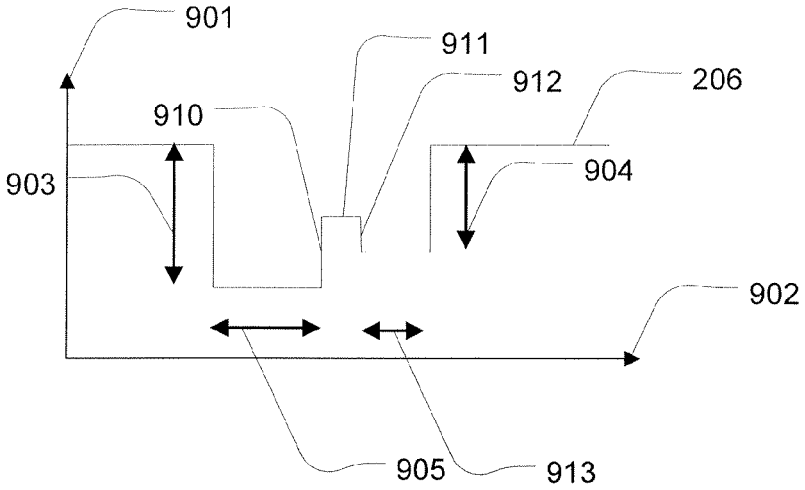
FIG. 9 shows magnetic field variations in a system according to an embodiment when a trolley and a booster-pack traverses the detection zone.

In FIG. 9 an additional embodiment is shown in which the received magnetic field signal 906 received by the magnetic field receiver 102 versus time 902 when, for example, a person is pushing a trolley in front of the person and the person additionally having a booster-bag for example a booster-backpack, is traversing the first detection zone 103. In the figure, the abscissa 901 denotes the magnitude of the received magnetic field signal at the receiver 102.

First, a decrease in the magnetic field signal 903 is observed due to the trolley entering the first detection zone 103. Based on the time-difference 905 for a first metal object 104 to traverse the first detection zone 103, the invention as disclosed above is able to determine that the first metal object is a trolley e.g. because the magnitude of the time-difference 905 is above a certain value. After the trolley has traversed the first detection zone 103, the magnetic field signal magnitude begins to increase 910. The magnitude of the increase 910 depends on, for example, the speed of the metal detector 111. The magnitude of the increase 910 may be up to the magnitude of the decrease 903. A short time 911 after the trolley has traversed the first detection zone, the magnetic field signal decreases 912 due to the entrance of a second metal object 104 (the booster-backpack) into the first detection zone 103. The decrease 912 may depend on the size of the second metal object 104. After the second metal object 104 has traversed the first detection zone 103, the magnetic field signal begins to increase 904. Based on the time difference 913, the invention is able to determine that a booster-backpack (and/or booster-bag) has traversed the first detection zone 103 e.g. because the magnitude of the time-difference 913 is below the abovementioned certain value. In case a booster-backpack is detected, the invention is able to start an alarm, as disclosed above. The increase in the magnetic field signal may be up to the background level (i.e. before the introduction of the trolley and the decrease 903). In general, the invention may detect any number and/or any types of metal objects 104 succeeding each other into the first detection zone 103.

FIG. 10 shows a data processing device 1000, comprising one or more micro-processors 1001 connected with a main memory 1002 and optionally e.g. a storage device 1006 via an internal data/address bus 1004 or the like. Additionally, the device 1000 may optionally also be connected to or comprise a display 1007. Further, the device 1000 comprises communication means 1003 for communication with one or more remote systems via one or more wireless and/or wired communication links 1008 such as, for example, a Bluetooth communication link, a WLAN communication link, an Infrared communication link, a fiber-optical communication link or the like. The memory 1002 and/or storage device 1006 are used to store and retrieve the relevant data together with executable computer code for providing the functionality according to the invention. The micro-processor(s) 1001 is responsible for generating, handling, processing, calculating, etc. the relevant parameters according to the present invention.

The storage device 1006 may comprise one or more storage devices capable of reading and possibly writing blocks of data, e.g. a DVD, CD, optical disc, PVR, etc. player/recorder and/or a hard disk (IDE, ATA, etc), floppy disk, smart card, PC card, USB storage device, etc.

The device 1000 may optionally comprise a user interface input/output unit 1005 through which a user may interact with the device 1000.

In general, any of the technical features and/or embodiments described above and/or below may be combined into one embodiment. Alternatively or additionally any of the technical features and/or embodiments described above and/or below may be in separate embodiments. Alternatively or additionally any of the technical features and/or embodiments described above and/or below may be combined with any number of other technical features and/or embodiments described above and/or below to yield any number of embodiments.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, Integers, steps or components but does not preclude the presence or addition of one or more other features, integers, steps, components or groups thereof.

The invention claimed is:

1. A method of preventing false alarms in a theft-preventing system comprising a magnetic field created by an active metal detector and determining a first detection zone; said method comprising the steps of detecting a first change in a parameter indicative of the magnetic field in said first detection zone due to a metal object entering the magnetic field created by the active metal detector;

detecting a second change in the parameter indicative of the magnetic field in said first detection zone due to the metal object leaving the magnetic field created by the active metal detector;

determining a time-difference between the detection of said first change in said parameter and the detection of said second change in said parameter;

performing an action based on said time-difference.

2. A method according to claim 1, wherein the step of detecting a first change in a parameter indicative of the magnetic field in said first detection zone comprises detecting a decrease in the parameter.

3. A method according to claim 1, wherein the step of detecting a second change in the parameter indicative of the magnetic field in said first detection zone comprises detecting an increase in the parameter.

4. A method according to claim 1, wherein the parameter is chosen from the group consisting of amplitude of the magnetic field; and phase of the magnetic field.

5. A method according to claim 1, wherein the step of performing an action based on said time-difference comprises performing a first action if said time-difference is above a first value; and performing a second action if said time-difference is below or equal to said first value.

6. A method according to claim 5, wherein the second action is chosen from the group consisting of sounding an alarm; transmitting a silent alarm to e.g. a pager;

setting off a visual alarm; and transmitting a signal to a video-surveillance system indicating to the video-surveillance system to start monitoring.

7. A method according to claim 5, wherein the first action comprises refraining from sounding an alarm.

8. A method according to claim 5, wherein the first value is chosen from the group consisting of substantially a second; and in the interval 0.5 seconds to 3 seconds.

9. A method according to claim 1, wherein the theft-preventing system further comprises a tag-based theft-preventing system for detecting a tagged object in a second detection zone determined by an electromagnetic field.

10. A method according to claim 9, wherein the tag-based system is chosen from the group consisting of resonance circuit system;

RFID system; and

Diode system.

11. A method according to claim 9, wherein an overlap between said first detection zone and said second detection zone is chosen from the group of coinciding;

disjoint; and partially overlapping.

12. A device for preventing false alarms in a theft-preventing system comprising a magnetic field created by an active metal detector and determining a first detection zone; said device comprising means for detecting a first change in a parameter indicative of the magnetic field in said first detection zone due to the metal object leaving the magnetic field created by the active metal detector;

means for detecting a second change in the parameter indicative of the magnetic field in said first detection zone due to the metal object leaving the magnetic field created by the active metal detector;

means for determining a time-difference between the detection of said first change in said parameter and the detection of said second change in said parameter;

means for performing an action based on said time-difference.

13. A device according to claim 12, wherein the means for detecting a first change in a parameter indicative of the magnetic field in said first detection zone are adapted to detect a decrease in the parameter.

14. A device according to claim 12, wherein the means for detecting a second change in the parameter indicative of the magnetic field in said first detection zone are adapted to detect an increase in the parameter.

15. A device according to claim 12, wherein the parameter indicative of the magnetic field is chosen from the group consisting of an amplitude of the magnetic field; and a phase of the magnetic field.

16. A device according to claim 12, wherein the means for performing an action based on said time-difference are adapted to perform a first action if said time-difference is above a first value; and perform a second action if said time-difference is below or equal to said first value.

17. A device according to claim 16, wherein the second action is chosen from the group consisting of sounding an alarm;

transmitting a silent alarm to e.g. a pager;

setting off a visual alarm; and transmitting a signal to a video-surveillance system indicating to the video-surveillance system to start monitoring.

18. A device according to claim 16, wherein the first action comprises refraining from sounding an alarm.

19. A device according to claim 16, wherein the first value is chosen from the group consisting of substantially a second; and in the interval 0.5 seconds to 3 seconds.

20. A device according to claim 12, wherein the theft-preventing system further comprises a tag-based system for detecting a tagged object in a second detection zone.

21. A device according to claim 20, wherein the tag-based system is chosen from the group consisting of resonance circuit system;

RFID system; and

Diode system.

22. A device according to claim 20, wherein the overlap between said first detection zone and said second detection zone is chosen from the group of coinciding;

disjoint; and partially overlapping.

23. A system for preventing false alarms in a theft-preventing system, comprising:

a tag-based theft-preventing device for detecting a tagged object and indicating the detection of a tagged object, a clock, an active metal detector, wherein the metal detector creates a magnetic field having a magnetic field parameter indicative of an opening and/or closing of a door, and means for determining that the tag-based theft-preventing device indicates the detection of a tagged object substantially at the same time as the metal detector indicates a change in the magnetic field parameter indicative of an opening and/or closing of a door and for restraining the system from sounding an alarm IF it is determined that the tag-based theft-preventing device indicates the detection of a tagged object substantially at the same time as the metal detector indicates a change in the magnetic field parameter indicative of an opening and/or closing of a door.

* * * * *